US007028988B2

(12) United States Patent
Scott

(10) Patent No.: US 7,028,988 B2
(45) Date of Patent: Apr. 18, 2006

(54) CABLE HANDLING SYSTEM

(75) Inventor: Gary Lee Scott, Sugar Land, TX (US)

(73) Assignee: PGS Americas, Inc., Houston, TX (US)

( * ) Notice: Subject to any disclaimer, the term of this patent is extended or adjusted under 35 U.S.C. 154(b) by 109 days.

(21) Appl. No.: 10/684,653

(22) Filed: Oct. 14, 2003

(65) Prior Publication Data

US 2005/0087731 A1 Apr. 28, 2005

(51) Int. Cl.
*B66D 1/00* (2006.01)

(52) U.S. Cl. ..... 254/277; 254/278; 114/254; 212/309

(58) Field of Classification Search ..... 254/272, 254/273, 277, 278–280, 329, 332; 114/243, 114/244, 253, 254; 212/308, 309
See application file for complete search history.

(56) References Cited

U.S. PATENT DOCUMENTS 2,293,936 A * 8/1942 Crooke ..... 254/273
3,150,860 A * 9/1964 Nelson ..... 188/285
4,155,538 A * 5/1979 Claassen ..... 254/277
4,157,812 A * 6/1979 Bennett ..... 254/414
4,354,608 A * 10/1982 Wudtke ..... 212/308
4,544,137 A * 10/1985 Johnson ..... 254/337
4,724,970 A * 2/1988 Kuhn ..... 212/272
5,140,927 A * 8/1992 Tolefson ..... 114/244
5,230,588 A * 7/1993 Wittke et al. ..... 405/191
5,351,430 A * 10/1994 Hystad ..... 43/9.1

* cited by examiner

*Primary Examiner*—Emmanuel M Marcelo
(74) *Attorney, Agent, or Firm*—E. Eugene Thigpen

(57) ABSTRACT

A system or apparatus and method for retrieving cable from water during marine operations is provided that reduces damage to the cable from pulling forces during the retrieval. A pulling device distributes the forces and stresses all along the cable components. In one embodiment, the pulling drive comprises a pulling drum powered by a clutching system or by a hydraulic torque conversion system set to slip or stall at a selectable force value. The apparatus may use a see-saw action to maintain the forces below damaging levels. The system may be adapted for deploying cable in marine operations as well.

32 Claims, 4 Drawing Sheets

CABLE HANDLING SYSTEM

BACKGROUND OF THE INVENTION

1. Field of the Invention

The present invention relates to cable handling systems, particularly systems for deploying and retrieving electrical and fiber optic cables. Most particularly, the invention relates to marine seismic cable deployment and retrieval systems for use in conjunction with a marine vessel.

2. Brief Description of Relevant Art

In many fields of endeavor, there is an on-going requirement to place packages of sensing equipment of various types across the earth's surface and on the seafloor. Such equipment is commonly intended to be used at one location for a period of time and then transported to a different location for further use. However, precisely deploying and later retrieving such equipment without damaging the equipment can be difficult. Operations in water, especially oceans, bays, and surf zones, can be especially problematic. The equipment commonly sinks into muddy and sandy sea beds and tends to suffer stress damage when removed.

Seismic cables can be especially difficult to handle because they are typically made of multiple components such as electrical conductors, fiber optics, and stress supporting members all bundled together and covered with a protective jacketing material. Handling or pulling the cable causes these components to slip and move with respect to one another. Tension applied to the outer jacket pulls the jacketing material which then pulls on the inner components of the cable. This distribution of stresses applies differing stress values and elongation amounts to the different components of the cable. Even cables where the stress members are embedded into the outer jacket have such a stress distribution, although to a lesser degree. Propagation of stress through a cable's components changes and deteriorates the components and consequently reduces the cable's useful life.

In water, the platform or vessel used to deploy and retrieve the cables often contributes due to the action of the water. Pulling cable up from a sea bottom and through sea bottom material is stressful to equipment in the cable, but simply pulling the cable through water is also stressful. Typically the cable will be curved in the water, extending downwardly from a platform and curving to a horizontal position along the sea bottom. The curve's length and shape will depend on the rate of retrieval, the depth of the water, the amount of cable sunk into the sea bottom, and the value of the applied pulling tension. The curve of the cable inevitably causes portions of the cable to be pulled sideways through the water, creating vortexes in the water, cable strumming, and drag on the cable, and adding further to the stresses on the cable. Such pulling tensions can exceed the strength of the cable, causing it to break. Similarly, tensions caused by pulling of the cable due to heaving of the vessel on ocean waves and swells can exceed the strength of the cable, causing it to suffer elongation damage and even break. The cable strength is commonly only a tiny fraction of the applied forces that potentially may be applied against the cable.

A need exists for systems and methods for deploying and recovering cables that reduce the destructive forces against such cables, particularly when the cables are distributed along a sea bed or in water.

SUMMARY OF THE INVENTION

The present invention provides a system, method and apparatus for retrieving cable from the water during marine operations and is especially advantageous for use with floating vessels. The invention may be utilized for deploying cable in marine operations as well.

According to the method of the invention, the retrieval of the cable is conducted while monitoring and adjusting the pulling forces on the cable so as to reduce or prevent damage to the cable from such forces during the retrieval. A pulling device that distributes pulling forces and stresses among the cable components is used to pull the cable for its retrieval. The device may employ a see-saw action, that is, a pulling and playing back of the cable, to maintain the forces below the damage point for the cable.

A preferred embodiment comprises a pulling drum capable of pulling the cable by wrapping the cable around the drum, thereby distributing pulling forces across the components of the cable. The pulling drum may be powered by a drive motor with a regulatable torque drive for adjusting the forces on the cable. Alternatively, the drum may be powered by a clutching system or by a hydraulic torque conversion system set to slip or stall at a selectable force value. Any means for powering the drum may preferably allow payback of the cable to lessen forces on the cable if needed to avoid damage to the cable. Preferably the apparatus or system will also have a front-mounted damper arm with an adjustable tension range positioned in front of the pulling drum to dampen stress on the cable, particularly stress caused by the movement of the water.

The retrieved cable is preferably stored in a storage area that will avoid tangling or twisting of the cable. The storage area preferably includes a cage within which the cable is stored, with the attachments preferably positioned or stored on the outside of the cage.

BRIEF DESCRIPTION OF THE DRAWINGS

FIG. 1(*b*) is a schematic of the pulling drum and damper arm of the embodiment of the system of the invention of FIG. 1(*a*) but with the damper arm in a lowered position.

FIG. 1(*c*) shows a system for regulating drive torque.

FIG. 2(*b*) is an exploded side view of the cable storage assembly shown in FIG. 2(*a*).

FIG. 2(*c*) is an exploded top view of the cable storage assembly shown in FIG. 2(*a*).

DETAILED DESCRIPTION OF PREFERRED EMBODIMENTS

According to the invention, a pulling device is provided that allows cable to be retrieved from water and sea beds without damage or fouling from the pulling process to either the cable components or attachments to the cable, even though such attachments may be wider than the cable itself. Cable components may include, for example, internal stress members, protective jackets, electrical and fiber optic conductors and insulating layers. Attachments to the cable may include, for example, sensor packages and other electrical or fiber optic equipment.

The pulling device distributes pulling forces and stresses among preferably all of the cable components, most preferably substantially equally among all of the cable components, including internal stress members of the cable and external jacketing material.

Figure 1A:
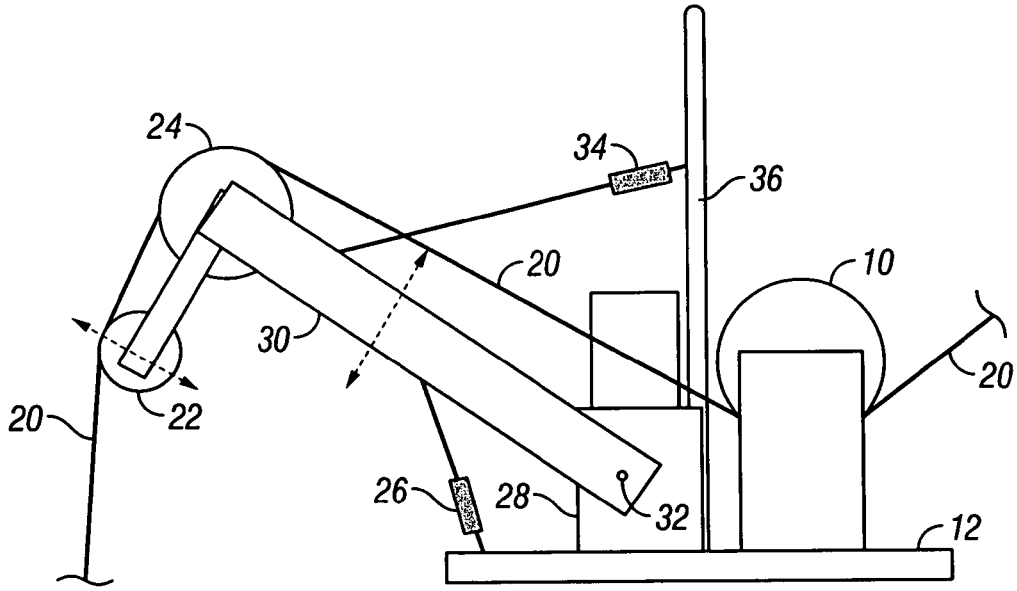
FIG. 1(*a*) is a schematic of the pulling drum and damper arm of one embodiment of the system of the invention wherein the damper arm is in a raised position.
Figure 1B:
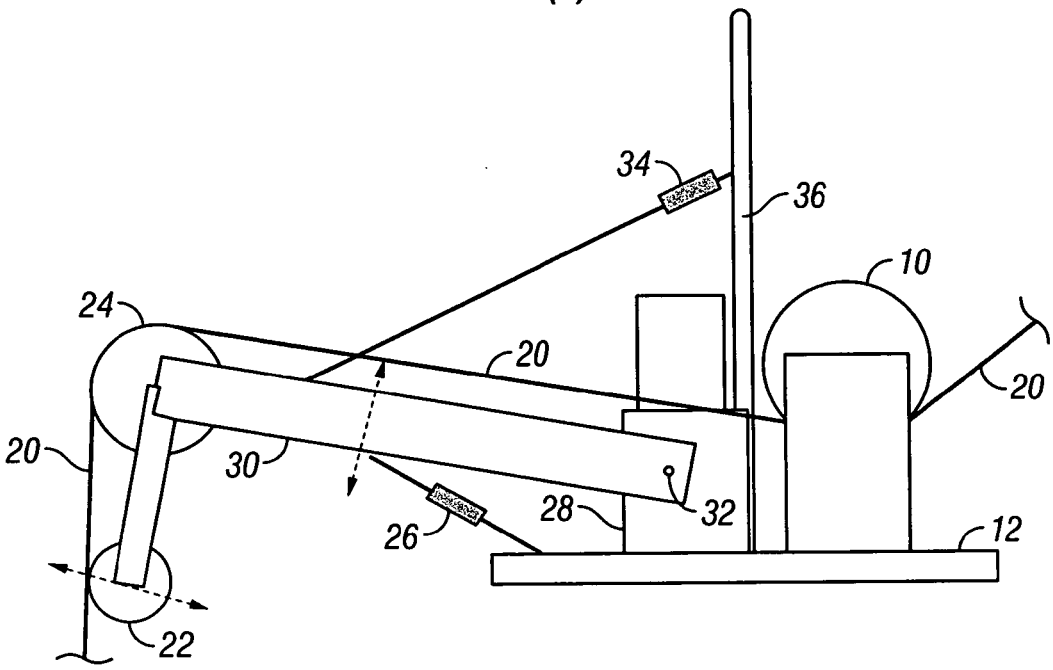
Figure 1C:
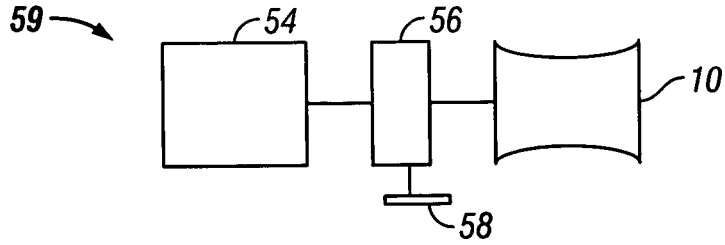
Figure 2A:
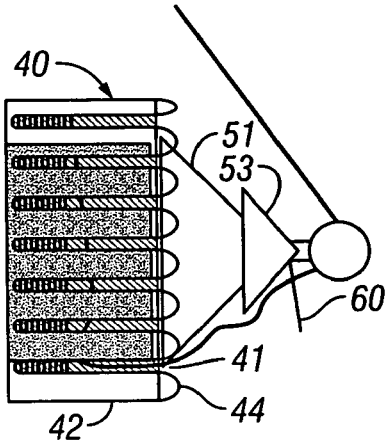
FIG. 2(*a*) is a side view of the cable storage assembly of one embodiment of the system of the invention.
Figure 2B:
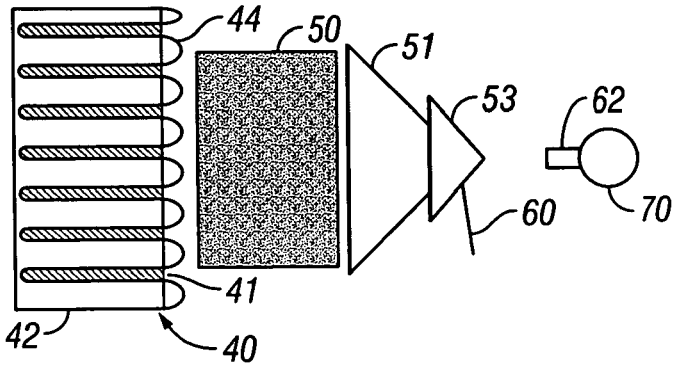
Figure 2C:
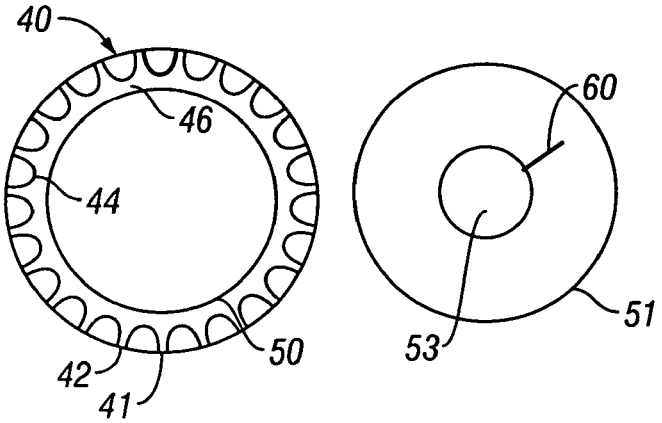
Figure 2D:
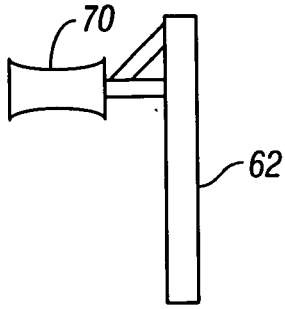
Figure 3:
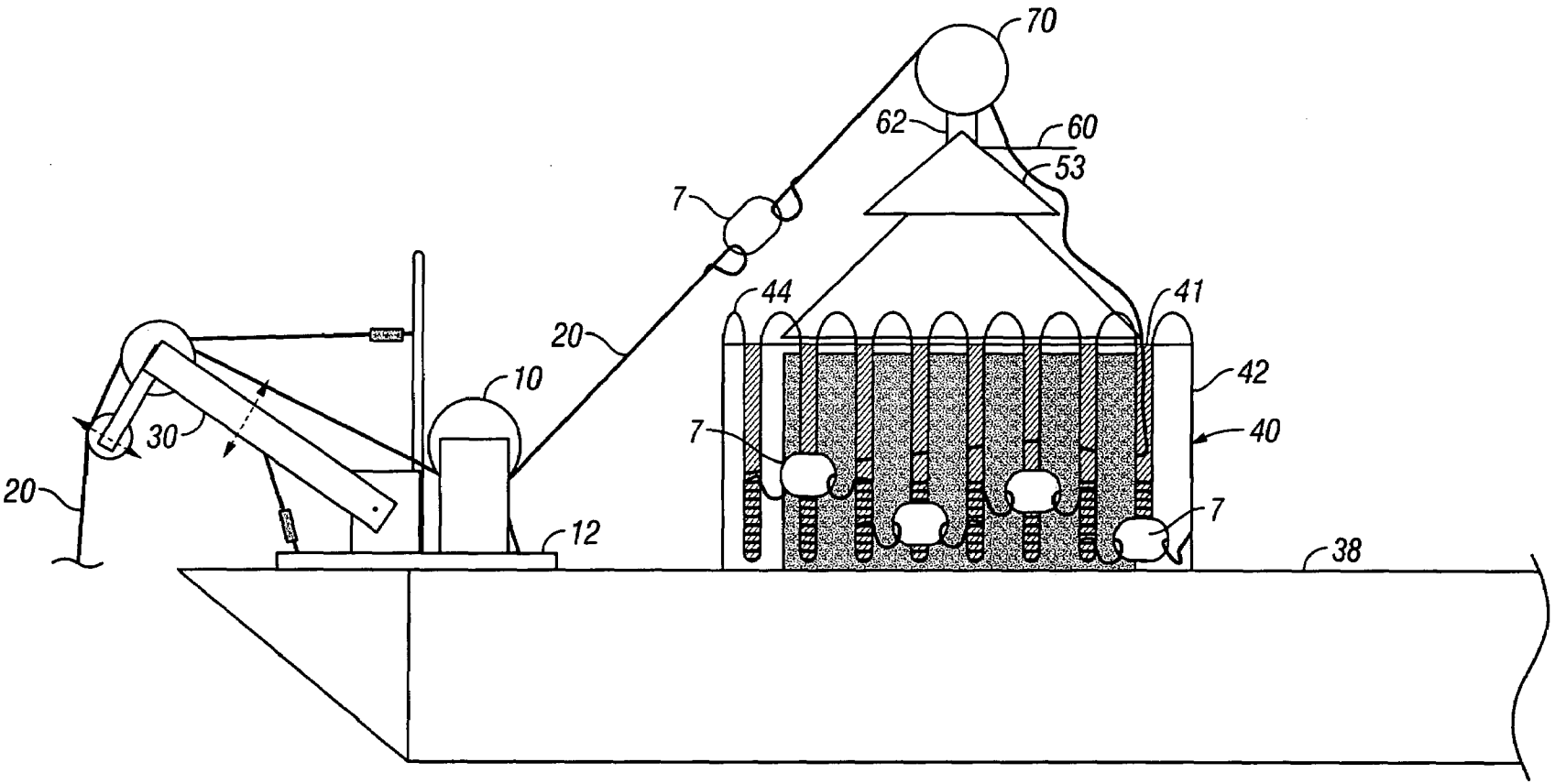
FIG. 3 is a schematic of one embodiment of the system of the invention in use retrieving cable wherein the system comprises the pulling drum and damper arm shown in FIGS. 1(*a*) and 1(*b*), the cable storage assembly shown in FIGS. 2(*a*) and 2(*b*) and a powered drum for carrying cable from the pulling drum to the storage assembly.

In a preferred embodiment, referring to FIGS. 1(*a*) and 1(*b*), the pulling device comprises a pulling drum 10, rotatably mounted on a preferably firm, stationary or relatively level or horizontal mounting base plate 12, which is typically affixed to a platform or marine vessel 38, as shown in FIG. 3. As the pulling drum 10 is rotated, the cable 20 is pulled up to accomplish the cable retrieval process. Sufficient compressional forces to distribute pulling forces among all the cable components, and sufficient frictional forces to retrieve the cable 20, can normally be achieved by wrapping the cable 20 around drum 10 less than a full circumference, as shown in FIGS. 1(*a*) and 1(*b*), although cable 20 may be wrapped around drum 10 a plurality of times. Because of the compressive force between the pulling drum 10 and the cable 20, the pulling forces on the cable will be transmitted internally within the cable to each component of the cable, thereby substantially equalizing the pulling forces on each component of the cable. Drive torque may be applied to the drum 10 by any available means known to those of ordinary skill in the art, such as electric motor, shown schematically in FIG. 1(*c*), or hydraulic, or mechanical means, for example. The cable tension may be monitored by monitoring the position of the damper arm or the drive power applied to the drum, and the drive torque applied to the drum 10 regulated in response to the measured tension to control the force on the cable 20. Alternatively, the drive torque may be regulated or adjusted through a clutching system or hydraulic torque conversion system 59, shown schematically in FIG. 1(*c*), that may be set to slip or stall at a selected force value (i.e., an amount of force that should preferably not be exceeded to ensure no damage to the cable, most preferably with a margin for error built into the value). As shown in FIG. 1(*c*), clutching or hydraulic conversion system 59 comprises motor 54 which applies power to drum 10 through clutch or torque converter 56. The drive torque may be set to stall at a selected force by drive torque control 58. In either case, if the tension or force on the cable 20 continues to exceed the selected force amount, the drive torque means will stall so that drum 10 will initially discontinue forward rotation, and if stalling is not sufficient to prevent further increases in the tension on the cable, the system will allow drum 10 to rotate in the reverse direction, and the cable 20 to pay back out to lessen the tension or force on the cable 20. As the extreme tensions relax, the system will resume retrieval of the cable, i.e., the drum 10 will resume forward rotation. The swing of the damper arm also functions to limit tension. In very high wave action, the alternate pulling in and playing out of the cable according to the invention to prevent the maximum applied tensions from being exceeded can produce a "see-saw" action.

Referring again to FIGS. 1(*a*) and (*b*), in a preferred embodiment of the invention, a front mounted damper arm 30 is positioned in front of the pulling drum 10 and preferably substantially at the entry point of the cable from the water onto the retrieval vehicle, which may be a boat or other floating vessel or platform. The damper arm 30 performs a dampening function, to compensate for vessel movement, to keep the tension on the cable 20 within a consistent range. With increasing pull force, the damper arm 30 will tilt downwardly, to reduce or counteract the increasing tension in the cable. The tension forces required to pull the damper arm 30 down increases with the arm's travel distance. The tension range of damper arm 30 is preferably adjustable so as to handle an assortment of cable tension requirements within the mid point of the arm travel. Shock absorber 34, extending between damper arm 30 and mast 36, and shock absorber 26, extending between damper arm 30 and base plate 12 (or vessel 38) function to substantially isolate cable 20 from sudden vessel movements. Mast 36 may be attached to mounting base plate 12 or vessel 38, by standard mounting means known to those of ordinary skill in the art.

The damper arm 30 is preferably mounted so that the damper arm 30 can rotate about a rotation point 32 on mounting base 28, which is also rotationally mounted on base plate 12 so that mounting base 28 can swivel horizontally. Accordingly, damper arm 30 can provide a "following" action with respect to the cable 20. That is, the damper arm 30 preferably moves or swivels as the floating vessel containing the damper arm 30 drifts in the water due to wind and water current forces, so that the damper arm points in directional alignment with the deployed cable 20. The damper arm 30 also preferably contains alignment devices comprising rollers or sheaves 22 and 24 to align any attachments or components attached to the cable with the cable to aid the cable's passage through the roller system comprising drums (or sheaves) 10 and 70.

A preferred embodiment of the invention further provides a storage system for the retrieved cable (or for the cable prior to deployment). In one embodiment, the storage system provides for the storage of the cable and any attachments to the cable in a holding area, preferably or typically including a cage, with the attachments preferably positioned or stored on the outside of the cage, for easy access if desired or needed, with the cable storage being controlled so as to prevent fouling and tangling of the cable and attachments with one another.

Referring to FIGS. 2(*a*), 2(*b*) and 2(*c*) for a preferred embodiment of such a storage system, in which FIG. 2(*a*) is an assembled view, FIG. 2(*b*) is a side view and FIG. 2(*c*) is a top view. The storage system comprises a cage 40, preferably substantially circular or oval, whose outside perimeter 42 has a plurality of vertical slots 41 extending from the top edge of outside perimeter 42 at least part way down the side of cage 40 so that the cable 20 may exit the cage through one slot 41 and re-enter at another such slot. The slots enable a cable with one or more attachments 7 (as shown in FIG. 3) to be brought outside the cage 40 at the approximate location of the attachment so that the attachment may be positioned or hung on the outside of the cage 40 and the cable then returned or allowed to re-enter the cage for continuation of the cable storage process.

Inside cage 40 is another smaller cage 50, preferably also circular or oval, and preferably centered on the same point as the cage 40, so that a raceway area or path 46, shown more clearly in FIG. 2(*c*), is formed between outside perimeter 42 of cage 40 and cage 50. The top of cage 50 is preferably a cone 51 having a base or bottom perimeter preferably substantially coextensive with the perimeter of cage 50. This conical shape facilitates storage of the cable 20 by enabling the cable that is being stored to slide down the cone 51 into the raceway area 46. Attached to the top of cone 51 is another, smaller cone, 53, preferably rotatably mounted on cone 51 and attached or associated with a drive motor so that cone 53 can rotate on its central axis about the top of cone 51. An arm 60 preferably protrudes from the cone 53 and is preferably attached to cone 53 so that said arm 60 rotates with cone 53 to sweep around above cone 51 to catch and move any suspended cable toward the cone 53 so that the cable will be directed and deposited in the raceway area 46. Most preferably, the cable will be deposited in layers in raceway area 46.

As shown more clearly in FIG. 3, as cable 20 is being retrieved, cable 20 travels from drum 10 and around powered guide roller 70, from which cable 20 is allowed to fall toward smaller cone 53. Cable 20 is caught by guide arm 60, which sweeps cable 20 around smaller cone 53 and cone 51, so that cable 20 slides down cone 51 and is deposited in a circular pattern within raceway 46 between outer cage 40 and inner cage 50. Guide roller 70 is supported above small cone 53 by support arm 62, as illustrated in a first side view in FIG. 2(*b*) and in a second side view (orthogonal to the first side view) in FIG. 2(*d*). Support arm 62 is supported from mounting base plate 12 or vessel 38, by any ordinary means known to those of ordinary skill in the art.

In an alternative embodiment, arm 60 might have its own means for rotation and be independent of any rotation of cone 53. In such embodiment, arm 60 would not be attached directly to cone 53.

Referring to FIG. 3, guide roller 70, comprising a powered drum, preferably delivers the cable 20 from the pulling drum 10 and deposits the cable 20 vertically above the peak of the cone 53 so that the rotating arm 60 will cause the cable 20 to be deposited around the cage 50 in raceway 46. Depositing the cable 20 in this manner allows the cable to lie down unstressed and to be deployed back out of the cage 40 in the same manner and direction so as not to impart any residing twist into the cable when so deployed. Thus, when the cable is pulled back out of the storage area, the cable has no twist stresses that need to be removed during the re-deployment.

Preferably, the opening between cages 40 and 50 to raceway 46 will be sufficiently narrow to inhibit the entry into raceway (pathway) 46 of any attachments 7 on cable 20. Preferably, perimeter wall 42 will have a lip 44 extending from the wall 42 which, in combination with the edge of cone 51, will serve to catch or stop the entry of attachments 7 into raceway 46. Most preferably, such attachments 7 will bridge the entry space into raceway 46 and the cable will be directed by lip 44 into raceway 46 while the attachments remain held above the raceway 46. The attachments 7 may then be automatically or manually pulled to the outside of perimeter wall 42 where they will preferably be positioned in a holding bracket (not shown). Preferably, a portion of cable 20 associated with the attachment 7 will be pulled through a slot 41 to the outside of perimeter wall 42, along with the attachment. After the attachment 7 is positioned outside the perimeter wall 42, the associated cable may be returned manually or automatically to pathway 46 via another slot 41. That is, the cable exits from the raceway 46 with the attachment 7 via a slot 41, and returns back into raceway 46 by way of another slot 41.

Figure 4:
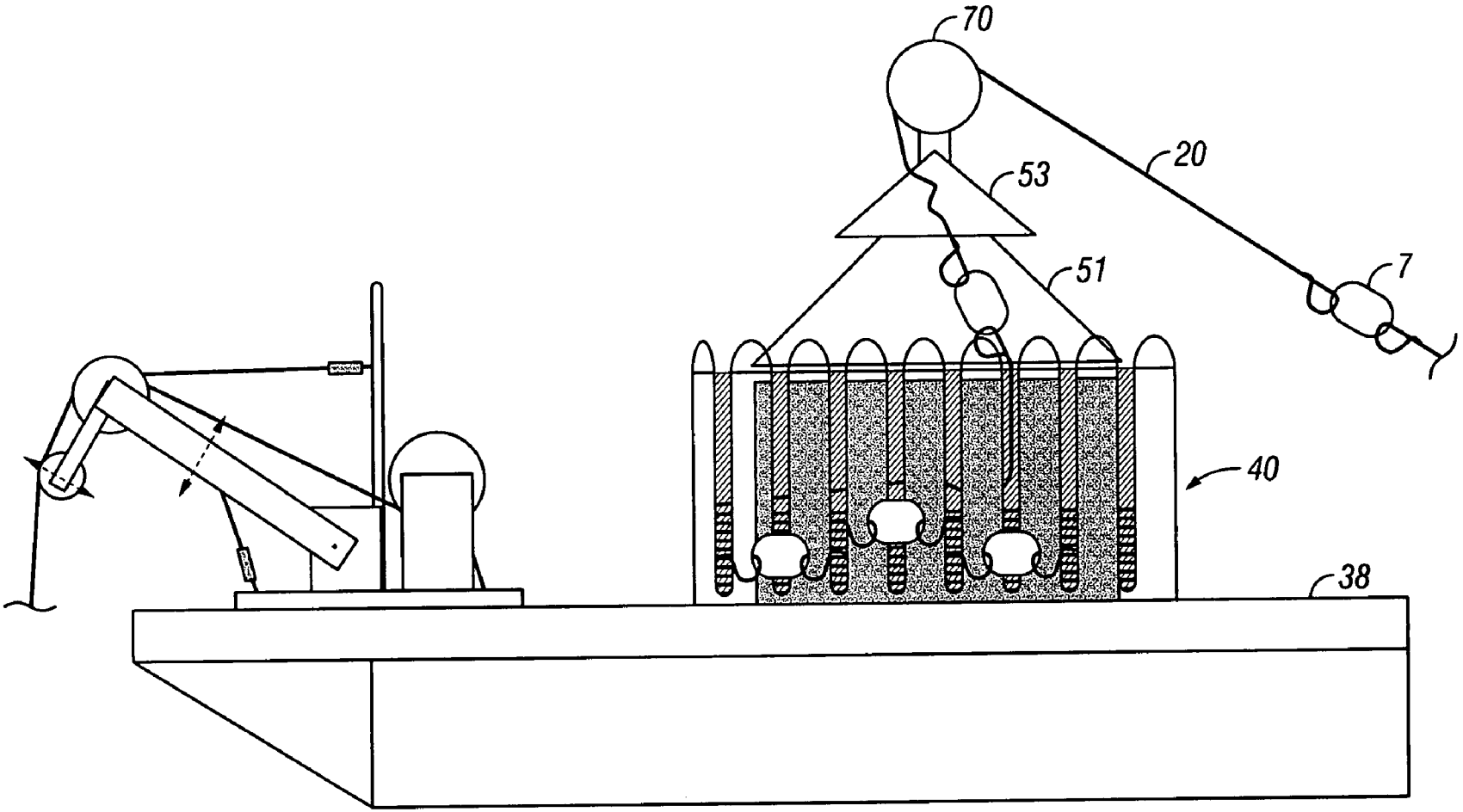
FIG. 4 is a schematic of one embodiment of the system of the invention shown in FIG. 3 but in use deploying cable.

Referring to FIG. 4, the cable 20 may be redeployed from storage cage 40 into the sea by running the cable from the raceway 46, up and out of the raceway 46, back up and along cone 53 and over the drum 70, which may now be set or used in either a freewheel or a powered mode. The cable may then be passed over any other required supporting drums until reaching the area for deployment into the water.

Often for re-deployment, the weight of the cable and its drag in the water are sufficient forces to pull the cable out of the raceway 46 and over the side of a floating vessel transporting the cable. When such weight is not enough to effect the re-deployment or it is desired to deliver excess cable into the water faster than can be achieved by the vessel's forward speed alone, the drum or roller 70 may be powered to pull the cable up and out of raceway 46.

The foregoing description of the invention is intended to be a description of preferred embodiments. Various changes in the details of the described systems, apparatuses and methods may be made without departing from the intended scope of this invention as defined by the appended claims.

What is claimed is:

1. A system for retrieving cable from water during marine operations employing a floating vessel, said system comprising:
   - a distributor for distributing forces across all components of the cable while pulling said cable;
   - an adjuster for automatically adjusting the pulling forces on the cable caused by movement of said vessel in the water; and
   - a holding area on said vessel for said cable, said holding area comprising a cylindrical cage whose outside perimeter has vertical slots from a top edge thereof and whose interior comprises a raceway path and a smaller diameter cylinder about the central point of said cylindrical cage.

2. The system of claim 1 wherein said distributor and adjuster employ a see-saw action in making the adjustments in the pulling forces.

3. The system of claim 1 wherein said distributor and adjuster comprise a pulling drum powered through a hydraulic torque conversion system set to slip or stall at a selectable force value, which if exceeded will allow payback out to lessen forces on the cable.

4. The system of claim 1 wherein said distributor and adjuster comprise a pulling drum powered through a hitching system set to slip or stall at a selectable force value, which if exceeded will allow payback out to lessen forces on the cable.

5. The system of claim 1 wherein said distributor and adjuster comprise a powered pulling drum with regulatable drive torque that may be monitored and adjusted to control the force on the cable.

6. The system of claim 5 wherein said pulling drum is powered by an electric motor.

7. The system of claim 5 wherein said pulling drum is powered by a mechanical motor.

8. The system of claim 5 wherein said pulling drum is powered by a hydraulic motor.

9. The system of claim 5 further comprising
   - a dampener for dampening stress applied to the cable from movements of said vessel, at least one roller for leading said cable to said pulling drum, and
   - a guider for guiding said cable over said at least one roller.

10. The system of claim 9 wherein said dampener and said guider comprise a damper arm located in front of said pulling drum at the entry point of the cable on said vessel.

11. The system of claim 9 wherein said dampener keeps tension on said cable constant.

12. The system of claim 1 wherein said distributor and adjuster comprise a pulling drum and a clutching system.

13. The system of claim 1 wherein said distributor and adjuster comprise a pulling drum and a torque conversion system.

14. The system of claim 1 wherein said smaller cylinder is topped with a cone whose base has the same diameter as said smaller cylinder.

15. The system of claim 14 wherein said cone is capped with a suspendably mounted smaller cone attached to a drive motor to rotate said smaller cone on its axis.

16. The system of claim 15 further comprising an arm protruding from said smaller cone for sweeping around and above said smaller cone to direct the cable to be deposited around the cage in the raceway area.

17. The system of claim 15 further comprising a powered drum for delivering the cable from said adjuster to said holding area.

18. The system of claim 17 wherein said powered drum delivers the cable to the peak of said smaller cone.

19. The system of claim 1 wherein said cable comprises attachments and said cylindrical cage comprises a lip extending from its inner wall for holding said cable attachments until the cable attachments fall outside said raceway.

20. The system of claim 19 wherein said raceway is smaller in width than the attachments to said cable.

21. The system of claim 19 wherein said lip directs the cable to fall into said raceway.

22. The system of claim 19 further comprising support brackets outside the cylindrical cage for receiving and holding said attachments to said cable.

23. The system of claim 19 wherein said attachments comprise electrical, electronic, acoustic, or fiber optic instruments or materials.

24. A method for retrieving cable from water in marine operations employing a floating vessel, while monitoring and adjusting the pulling forces on said cable during said retrieval to reduce damage to said cable from said forces during said retrieval, said method comprising pulling said cable with a pulling device that distributes pulling forces and stresses among all of the cable components, and that employs a see-saw action for adjusting said pulling forces to maintain said forces below the damage point for said cable; and depositing cable in a storage area on said vessel, said storage area comprising a cylindrical cage having at least two vertical slots and a central interior cylinder having a conical top and separated from an exterior cylindrical cage wall by a raceway area for the cable, and a conical cap with a protruding arm rotatably mounted on the conical top for receiving and directing cable into the raceway area.

25. The method of claim 24 further comprising delivering the cable from said pullingdevice to said storage area using a powered drum.

26. The method of claim 24 wherein the cable comprises at least one attachment of marine equipment, said method further comprising causing said attachment to fall outside said raceway area while the cable attaching said attachment is directed through said vertical slot into the raceway area.

27. The method of claim 24 wherein said pulling device comprises a pulling drum and a front-mounted damper arm having an adjustable tension range at the entry point of the cable on the vessel, and said method further comprises adjusting said damper arm so as to keep tension constant on the cable during pulling.

28. An apparatus for retrieving and deploying cable in marine operations, said apparatus comprising:

(a) pulley drum assembly comprising a pulling drum capable of pulling the cable while distributing pulling forces across all components of the cable;

(b) powered drive motor with regulatable torque drive for operating the pulling drum and adjusting the forces such pulling exerts on the cable;

(c) front-mounted damper arm with an adjustable tension range positioned prior to the drum pulley assembly to dampen stress on the cable caused by movement of water;

(d) storage system for said cable, said storage system comprising a cylindrical case having a smaller diameter cylinder about its central point and a raceway path in-between the smaller diameter cylinder and the interior wall of the outer-part of the cylindrical cage, wherein said smaller diameter cylinder has a conical top capped with a rotatably mounted cone; and (e) means for delivering cable from the pulley drum assembly to the storage system.

29. The apparatus of claim 28 wherein said tension exerted by said damper arm on said cable is reduced by lowering said damper arm toward the cable.

30. The apparatus of claim 28 wherein said powered drive motor comprises a hydraulic torque conversion system that slips or stalls at a selectable force value and that allows payback beyond said selectable force value, simulating a see saw action between the apparatus and the cable.

31. The apparatus of claim 28 further comprising at least one slit in said exterior wall.

32. A method for deploying cable employing the apparatus of claim 28, wherein said means for delivering the cable to the storage system is a powered drum, said method comprising deploying said cable using said powered drum and the cable's own weight.

* * * * *